US010258147B2

(12) United States Patent
Tseng

(10) Patent No.: US 10,258,147 B2
(45) Date of Patent: Apr. 16, 2019

(54) LIFTING DEVICE FOR LIFTING A TABLE

(71) Applicants: HI-MAX INNOVATION CO,.LTD, Taichung (TW); Yi-Chen Tseng, Taichung (TW)

(72) Inventor: Yi-Chen Tseng, Taichung (TW)

(73) Assignees: Hi-Max Innovation Co., Ltd., Taichung (TW); Yi-Chen Tseng, Taichung (TW)

( * ) Notice: Subject to any disclaimer, the term of this patent is extended or adjusted under 35 U.S.C. 154(b) by 417 days.

(21) Appl. No.: 15/293,754

(22) Filed: Oct. 14, 2016

(65) Prior Publication Data

US 2018/0064241 A1 Mar. 8, 2018

(30) Foreign Application Priority Data

Sep. 2, 2016 (TW) ..... 105128457 A

(51) Int. Cl.

| | |
|---|---|
| ***A47B 9/10*** | (2006.01) |
| ***A47B 13/08*** | (2006.01) |
| ***F15B 15/14*** | (2006.01) |
| *A47B 9/20* | (2006.01) |

(52) U.S. Cl.

CPC ..... *A47B 9/10* (2013.01); *A47B 13/081* (2013.01); *F15B 15/1409* (2013.01); *A47B 9/20* (2013.01)

(58) Field of Classification Search

USPC .... 254/89 H, 93 R; 108/144.11, 147, 147.19

See application file for complete search history.

(56) References Cited

U.S. PATENT DOCUMENTS

| | | | | |
|---|---|---|---|---|
| 4,711,184 A * | 12/1987 | Wallin | ..... | A47B 9/10 108/147 |
| 6,595,144 B1 * | 7/2003 | Doyle | ..... | A47B 9/00 108/147 |
| 2006/0075941 A1 * | 4/2006 | Seidl | ..... | A47B 9/02 108/102 |

* cited by examiner

*Primary Examiner* — Joseph J Hail

(74) *Attorney, Agent, or Firm* — Wang Law Firm, Inc.

(57) ABSTRACT

A lifting device for lifting a table includes two legs, each of the legs includes a pneumatic assembly and an inner rod, the pneumatic assemblies are disposed in the legs, and the inner rods are inserted in the legs and connected to the pneumatic assemblies, so that the pneumatic assemblies drive the inner rods to move up and down. A synchronization mechanism is disposed between the two legs, and has two ends connected to the inner rods by two connecting assemblies, so that the inner rods are driven by the synchronization mechanism to lift or lower the tabletop in a synchronous manner, the synchronization mechanism includes: a cable control unit and a clutch unit controlled by the cable control unit, the cable control unit includes a control handle and a cable which is disposed at the bottom of the tabletop.

10 Claims, 13 Drawing Sheets

LIFTING DEVICE FOR LIFTING A TABLE

BACKGROUND

Field of the Invention

The present invention relates to a component of a table, and more particularly to a lifting device for lifting a table.

Related Prior Art

A conventional pneumatic table is provided with two multistage pneumatic lifting devices at two ends of the bottom of the tabletop to adjust the height of the table.

However, the two multistage pneumatic lifting devices work independently from each other, and are therefore likely to move to different heights, which will cause tilting of the tabletop after height adjustment.

The present invention has arisen to mitigate and/or obviate the afore-described disadvantages.

SUMMARY

The present invention is aimed at providing a lifting device for lifting a table, which is provided with a synchronization mechanism between two legs of the table, so that the tabletop can be lifted or lowered in a synchronous manner To achieve the above objective, a lifting device for lifting a table comprises two legs at two ends of a bottom of a tabletop, each of the legs includes a pneumatic assembly and an inner rod, the pneumatic assemblies are disposed in the legs, and the inner rods are inserted in the legs and connected to the pneumatic assemblies, so that the pneumatic assemblies drive the inner rods to move up and down; the lifting device is characterized in that:

a synchronization mechanism is disposed between the two legs, and has two ends connected to the inner rods by two connecting assemblies, so that the inner rods are driven by the synchronization mechanism to lift or lower the tabletop in a synchronous manner, the synchronization mechanism includes: a cable control unit and a clutch unit controlled by the cable control unit, the cable control unit includes a control handle and a cable which is disposed at the bottom of the tabletop;

the clutch unit includes: a guide rod, and a base, a movable wheel, a rotary wheel which are inserted on the guide rod, and a drive member pivoted to the base, the guide rod has a non-circular cross section and is horizontally arranged with two ends connected to the two connecting assemblies, so that the guide rod is drivingly connected to the pneumatic assemblies of the legs, the base is fixed to the bottom of the tabletop and has a first end and a second end, an elastic member and an engaging hole are provided at the first end, a connecting hole which communicates with and has an inner diameter larger than an inner diameter of the engaging hole is formed in the second end, the second end is provided with a pivot end;

the drive member is a hollow frame with one end for fixing one end of the cable, and includes a pivotal end which is pivoted to the pivot end, and further includes a press portion;

the movable wheel includes an engaging end which is engaged in the engaging hole and provided with an axial hole, the movable wheel is movable in an axial direction of the engaging hole to press against the elastic member, an annular inner toothed portion is formed at another end of the movable wheel, the press portion is able to push against the movable wheel;

the rotary wheel includes a shaft portion at one end thereof, and an outer toothed portion at another end thereof, the rotary wheel is sleeved onto and rotates along with the guide rod, the shaft portion is inserted in the axial hole of the engaging end, the inner annular toothed portion of the movable wheel is able to engage with or disengage from the outer annular toothed portion of the rotary wheel, pulling the cable with the cable control unit can make the press portion of the drive member push the movable wheel to move, making the inner annular toothed portion of the movable wheel disengage from the outer annular toothed portion of the rotary wheel, the guide rod is able to make the two pneumatic assemblies lift or lower the tabletop in a synchronous manner.

Therefore, the lifting device for lifting a table of the present invention has the following advantages:

1. the synchronization mechanism is disposed between two legs of the table to enable the tabletop to be lifted or lowered precisely in a synchronous manner, and the tabletop not only can be adjusted in a multistep manner but also can be prevented from titling after height adjustment.

2. the movable wheel of the clutch unit is controlled by the cable control unit to engage with or disengage from the rotary wheel which is sleeved on the guide rod. When the movable wheel is pulled by the cable to push against the drive member, the movable wheel is disengaged from the rotary wheel. When the cable is released, the movable wheel can be pushed by the elastic member to engage with the rotary wheel again so as to stop the guide rod from rotation. Therefore, the height of the tabletop is fixed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

The present invention will be clearer from the following description when viewed together with the accompanying drawings, which show, for purpose of illustrations only, the preferred embodiment in accordance with the present invention.

Figure 1:
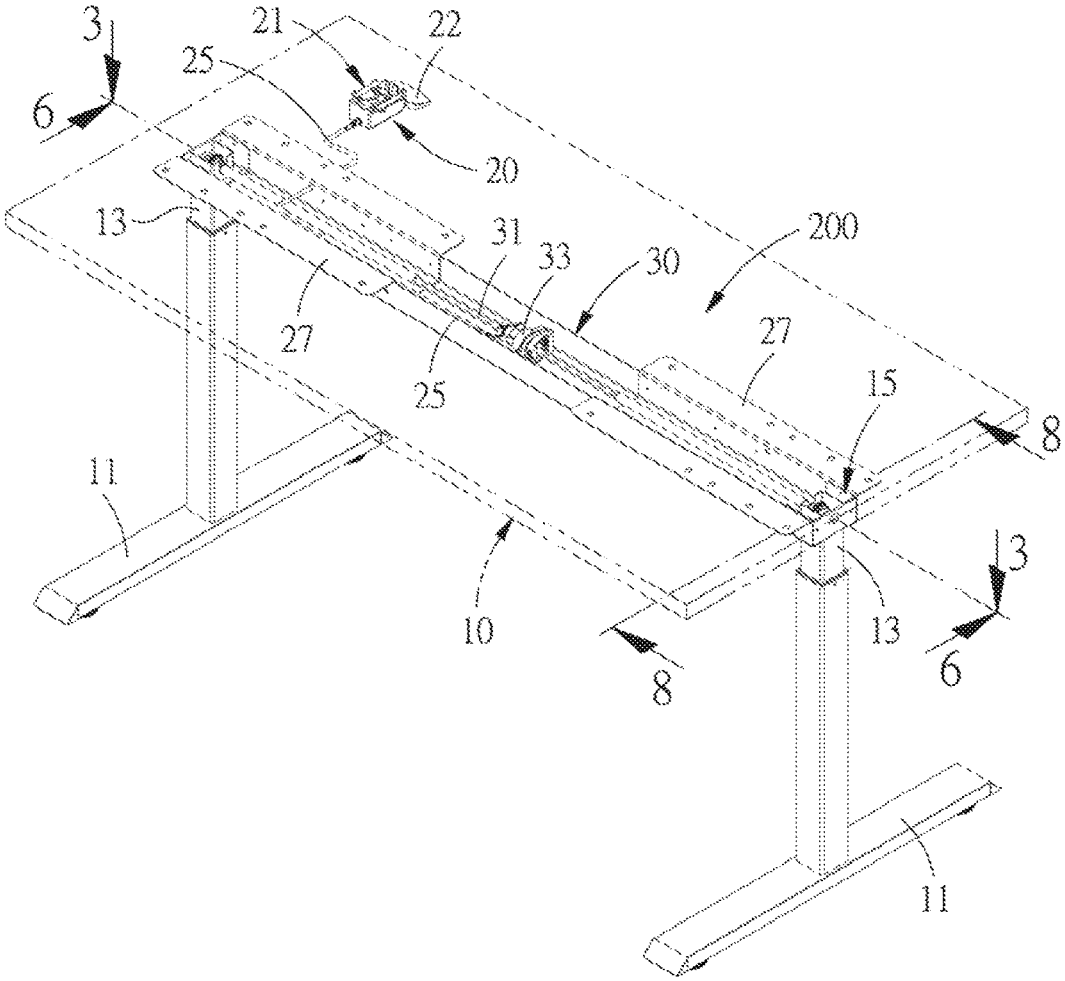
FIG. 1 is a perspective view of a lifting device for lifting a table in accordance with a preferred embodiment of the present invention.
Figure 2:
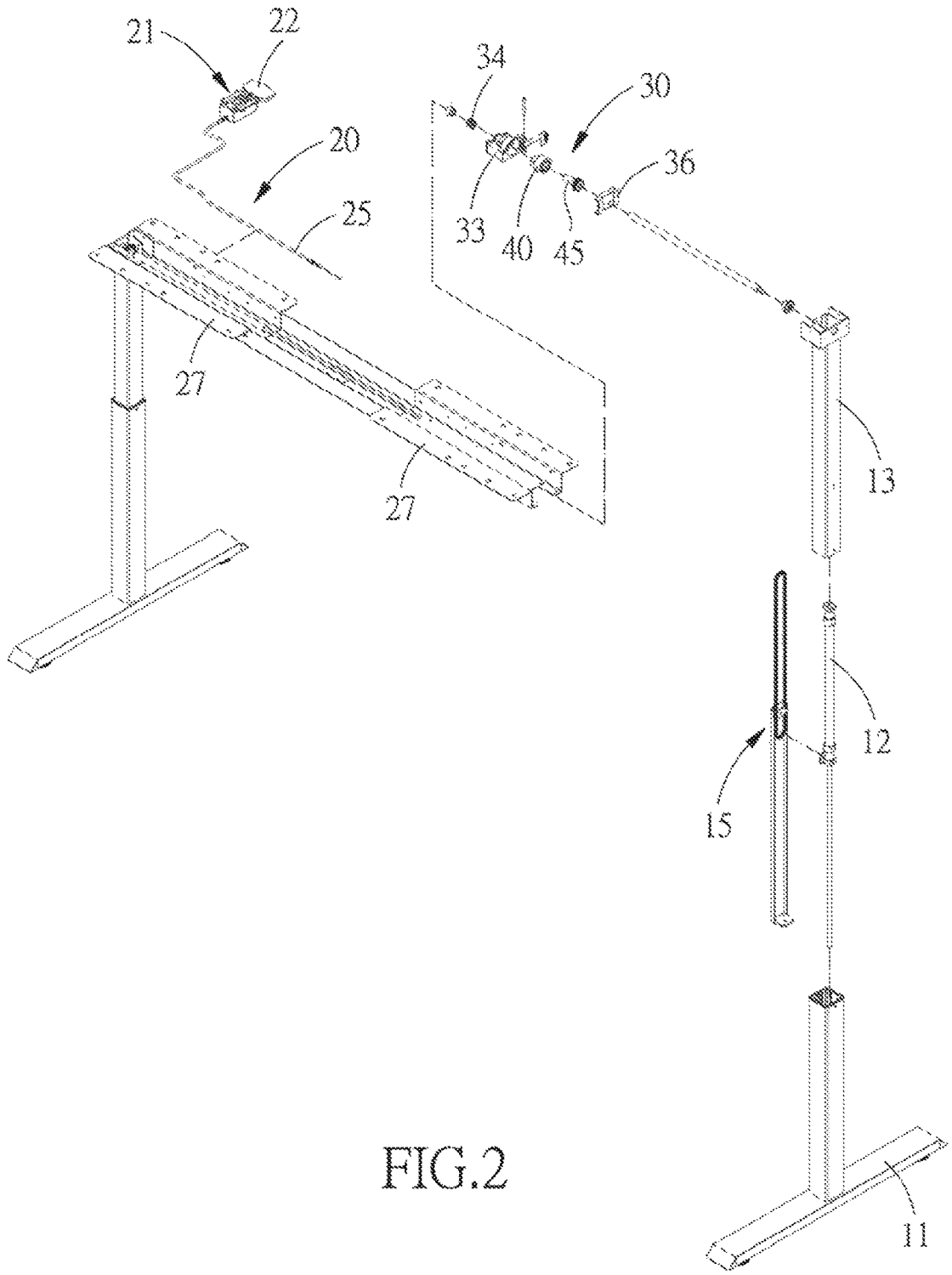
FIG. 2 is an exploded view of the lifting device for lifting a table in accordance with the preferred embodiment of the present invention.
Figure 8:
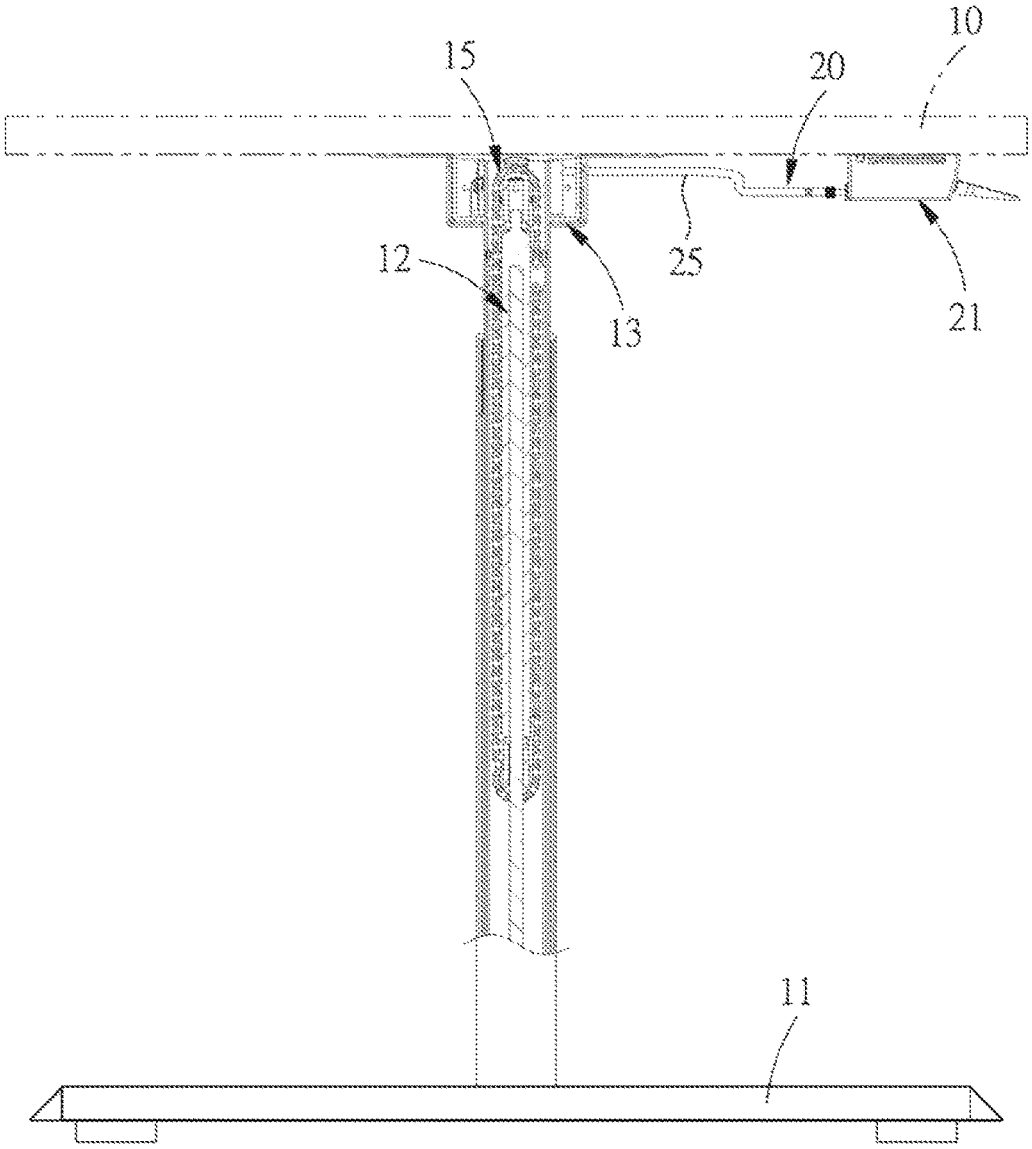
FIG. 8 is a side view of the lifting device for lifting a table in accordance with the preferred embodiment of the present invention.
Figure 9:
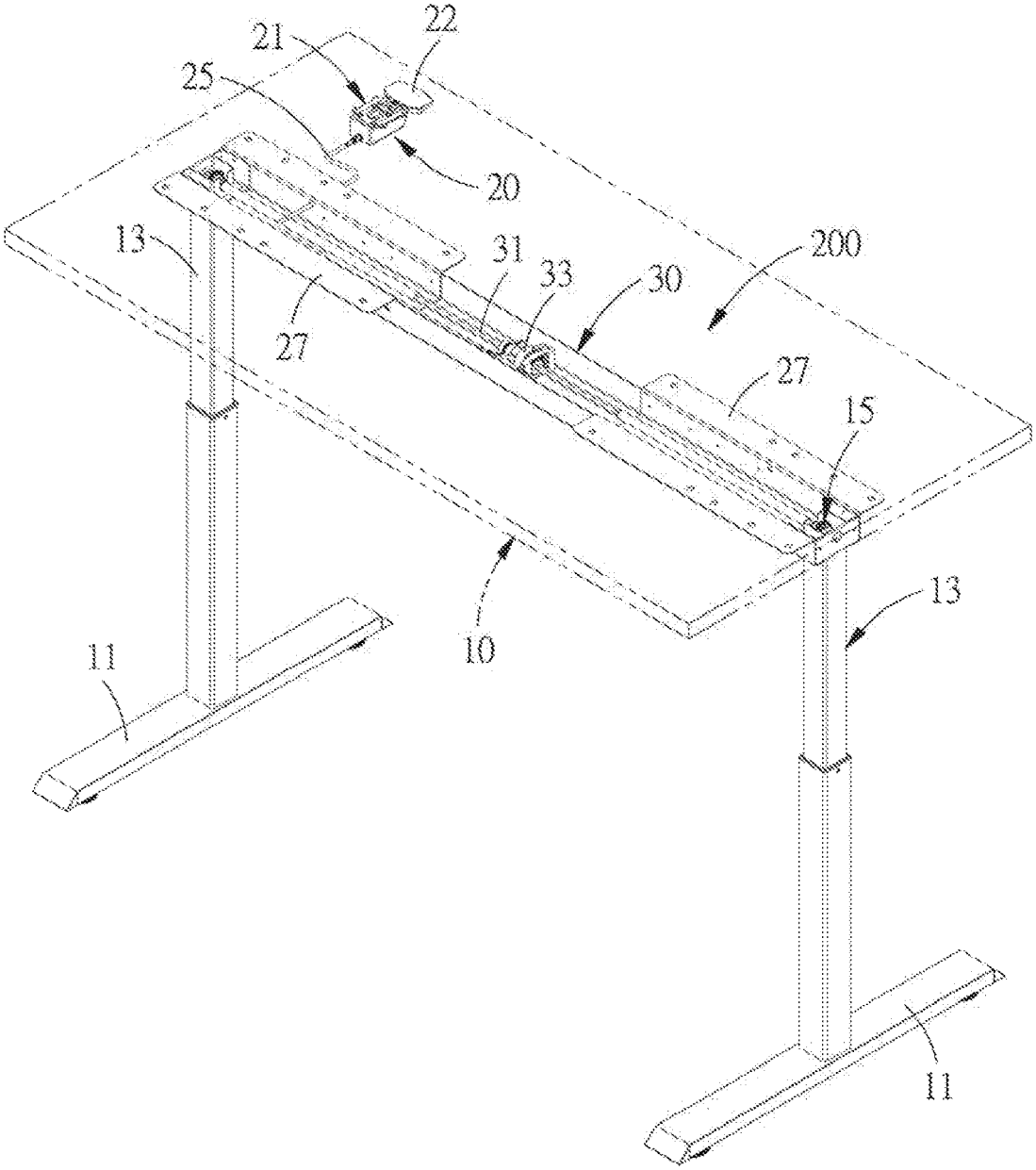
FIG. 9 is a perspective view of the lifting device for lifting a table in accordance with the preferred embodiment of the present invention.
Figure 10:
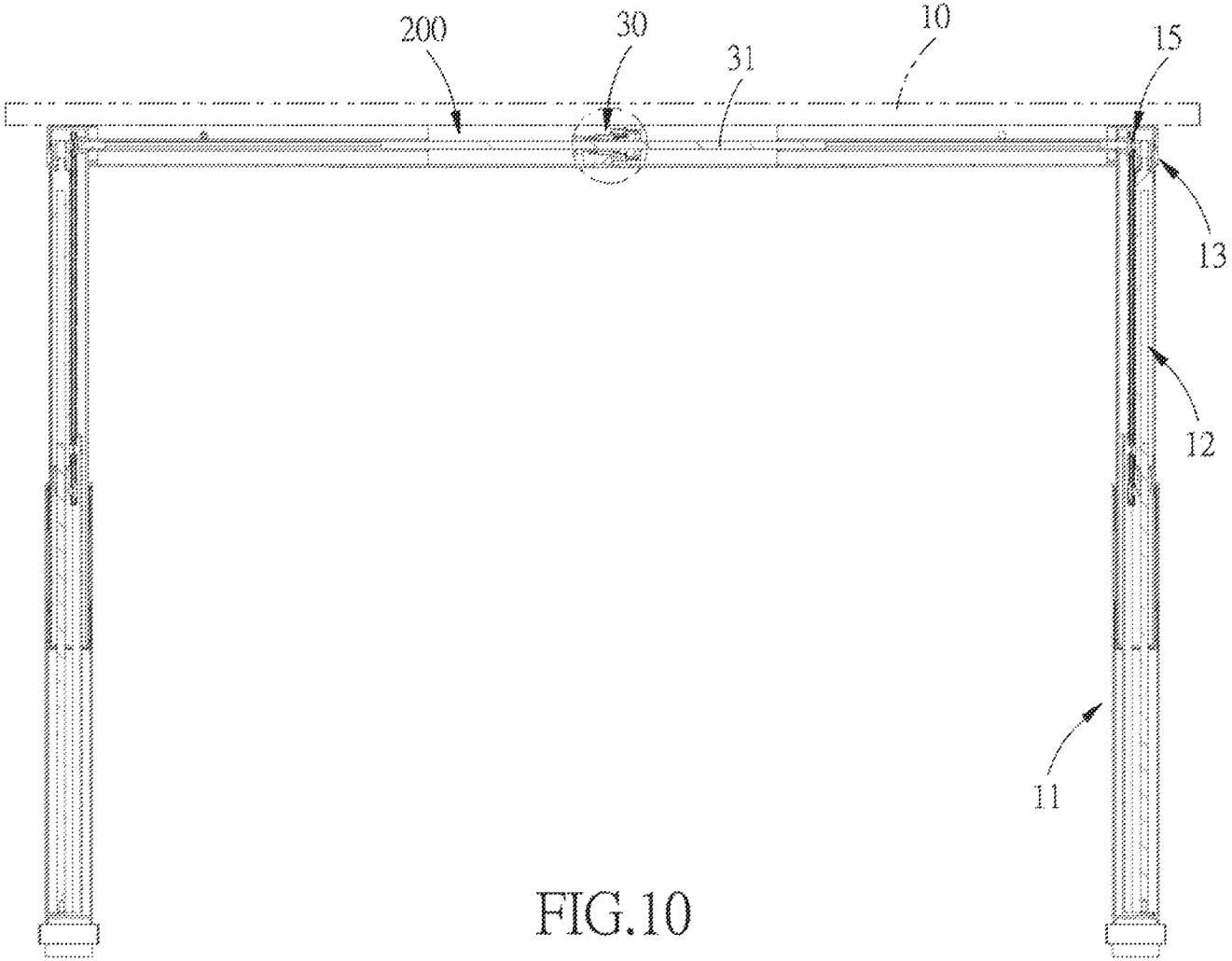
FIG. 10 is a front plan view showing the after-height-adjustment status of the lifting device for lifting a table in accordance with the preferred embodiment of the present invention.
Figure 11:
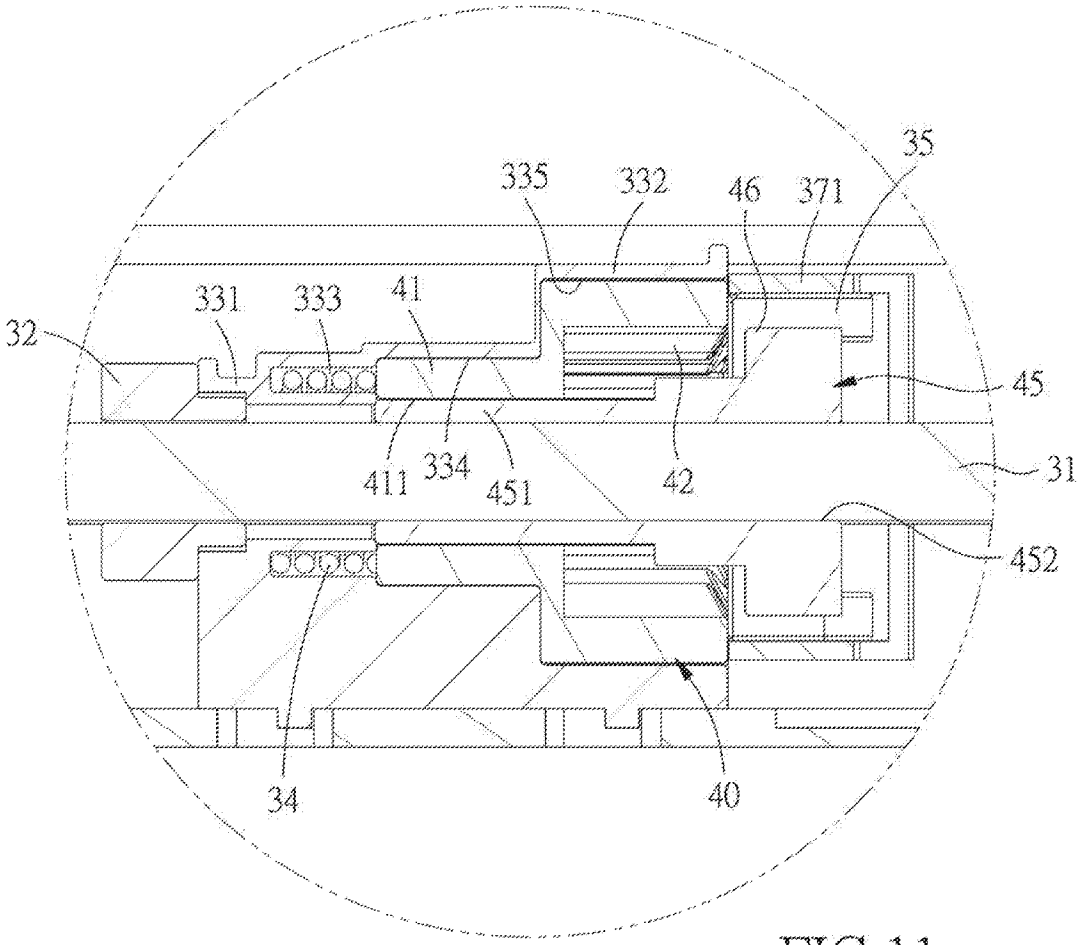
FIG. 11 is a cross sectional view showing that the clutch unit is in the disengagement position.
Figure 12:
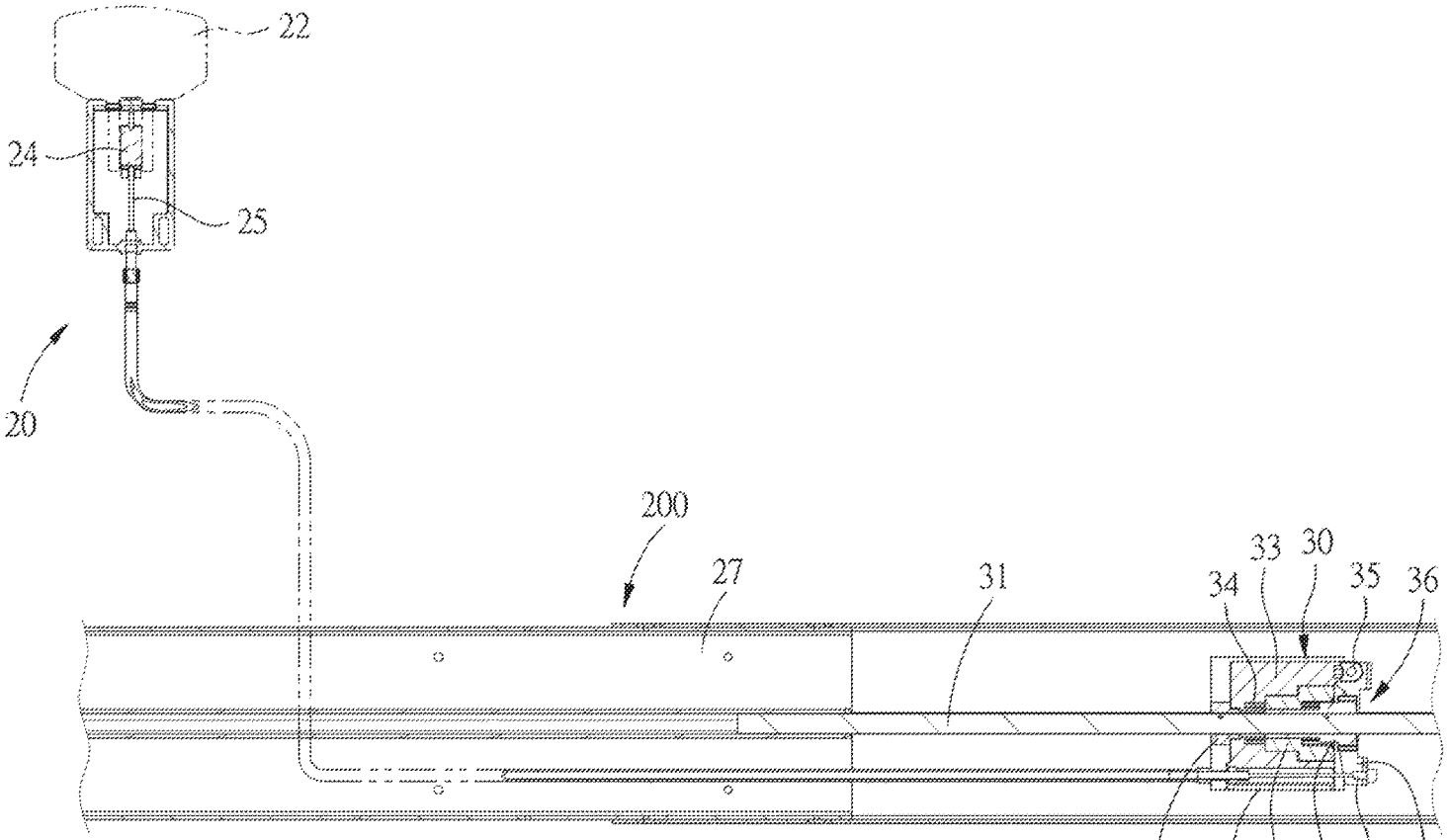
FIG. 12 is a cross sectional view of the present invention showing the synchronization mechanism.

Referring to FIGS. 1, 2 and 8, a lifting device for lifting a table in accordance with a preferred embodiment of the present invention is shown, wherein a leg 11 is provided at each of two ends of a bottom of a tabletop 10, and the lifting device further includes: a pneumatic assembly 12 and an inner rod 13. The pneumatic assembly 12 is disposed in the leg 11, and the inner rod 13 is inserted in the leg 11 and connected to the pneumatic assembly 12, so that the pneumatic assembly 12 drives the inner rod 13 to move up and down. The key feature of the present invention is that a synchronization mechanism 200 is disposed between the two legs 11, and has two ends connected to the inner rods 13 by two connecting assemblies 15, so that the inner rods 13 can be driven by the synchronization mechanism 200 to lift or lower the tabletop 10 in a synchronous manner.

Figure 3:
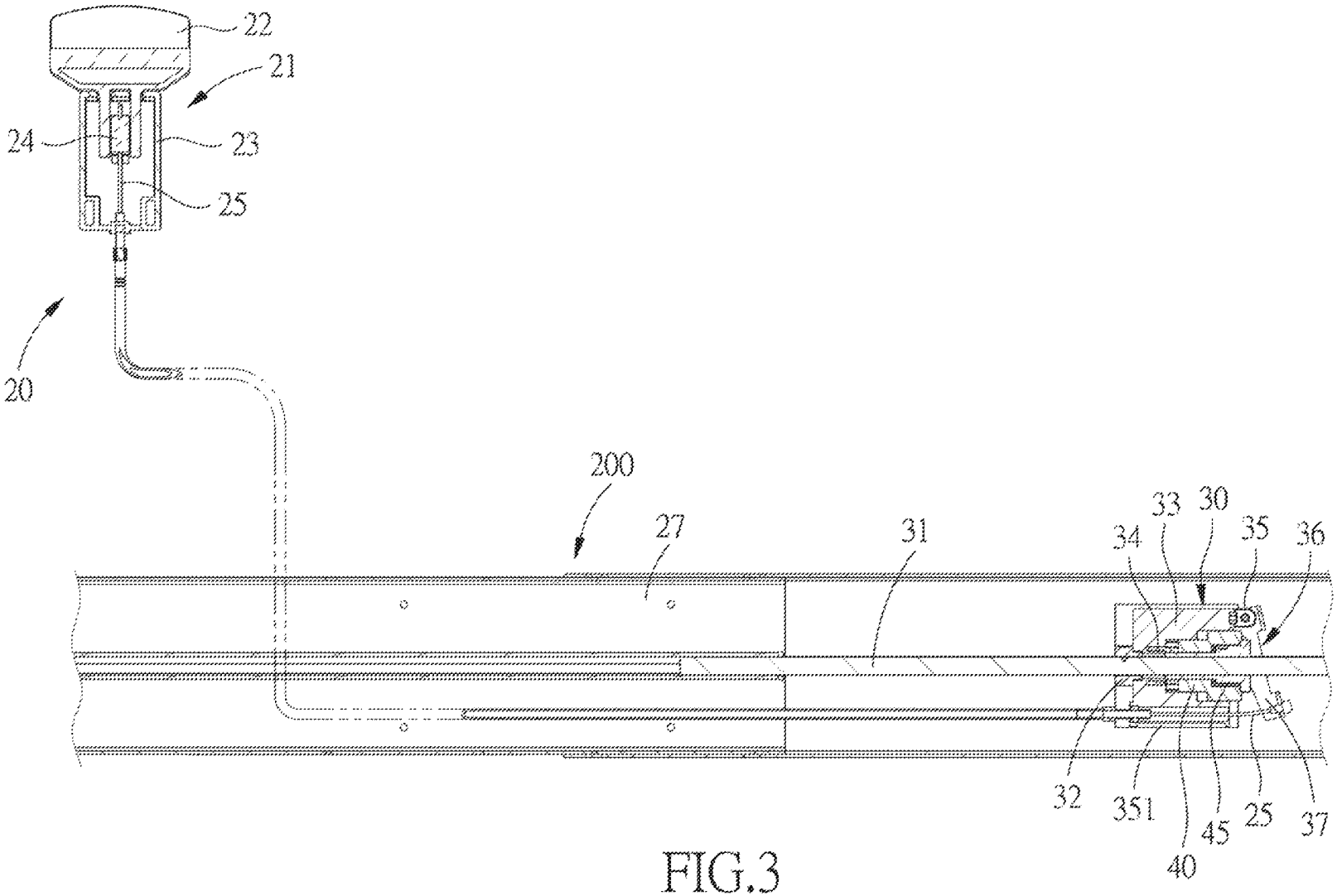
FIG. 3 is an assembly view of a synchronous mechanism of the lifting device for lifting a table in accordance with the preferred embodiment of the present invention.

The synchronization mechanism 200 includes: a cable control unit 20 and a clutch unit 30. The cable control unit 20, as shown in FIGS. 2 and 3, includes a control handle 21 and a cable 25. One end of the control handle 21 is a gripping portion 22 which is inserted in one end of a casing 23 and provided with a retaining block 24 to retain one end of the cable 25 which extends out of another end of the casing 23. In order to fix the cable 25 to the bottom of the tabletop 10, as shown in FIGS. 1 and 2, two fixing members 27 which are U-shaped in cross section are disposed at the two ends of the bottom of the tabletop 10 in such a manner that each of the fixing members 27 has two free ends fixed to the bottom of the tabletop 10 and connected to the top of a corresponding one of the inner rods 13.

Figure 13:
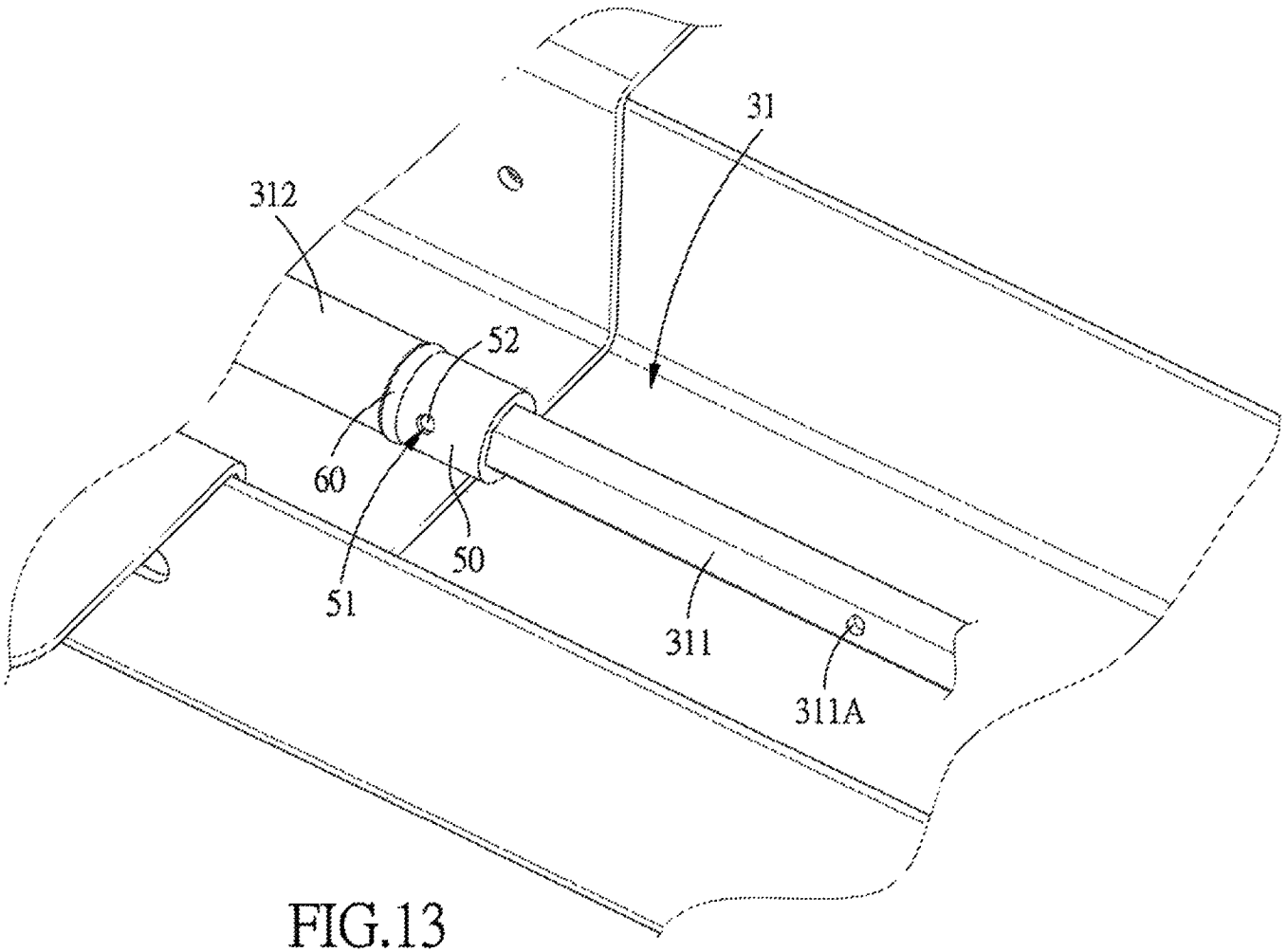
FIG. 13 is an enlarged view of a part of the present invention.

The clutch unit 30, as shown in FIGS. 3-5 and 13, includes: a guide rod 31, and a fixing member 32, a base 33, a movable wheel 40, a rotary wheel 45 which are inserted on the guide rod 31, and a drive member 36 pivoted to the base 33. The guide rod 31 has a non-circular cross section and is horizontally arranged with two ends connected to the two connecting assemblies 15. By arrangements, the guide rod 31 is drivingly connected to the pneumatic assemblies 12 of the legs 11. The connecting assemblies 15 can be the transmission devices in the form of sprockets or chains which cause up and down displacement of the pneumatic assemblies 12, and drive the synchronization mechanism 200 to move via the guide rod 31. In this embodiment, as shown in FIG. 13, the guide rod 31 includes an inserting section 311 and two movable sections 312 which are movably inserted at two ends of the inserting section 311 in order to fit different sized tabletops 10. If the tabletop 10 is large, the distance between the two legs 11 is also large, and if the tabletop 10 is small, the distance between the two legs 11 is relatively small. Therefore, the two movable sections 312 are movable to adjust the distance between the legs 11.

The present invention preferably further includes a restricting member 50 which is inserted onto and fixed to the inserting section 311 to restrict the movable sections 312 from displacement. The restricting member 50 includes a restricting hole 51, the inserting section 311 is provided with at least one inserting hole 311A, and then a fixing pin 52 is inserted through the restricting hole 51 and into the inserting hole 311A, so as to fix the restricting member 50 to the inserting section 311. There can be more than one inserting hole 311A, in order to fix the movable sections 312 at different positions.

Preferably, a washer 60 is sleeved onto the inserting section 311 and disposed between the restricting member 50 and the movable sections 312.

Figure 4:
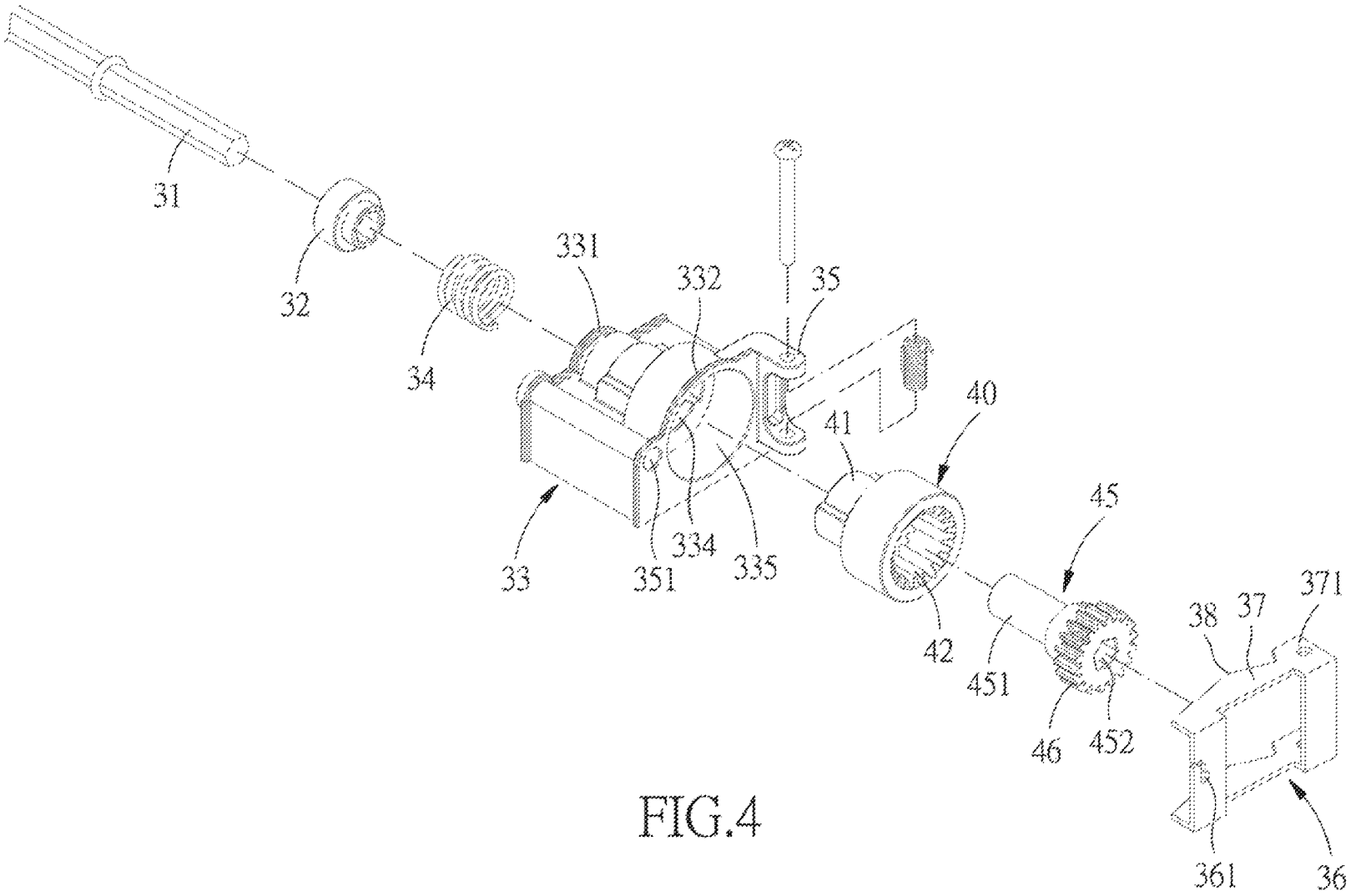
FIG. 4 is an exploded view of the clutch unit in accordance with the preferred embodiment of the present invention.
Figure 5:
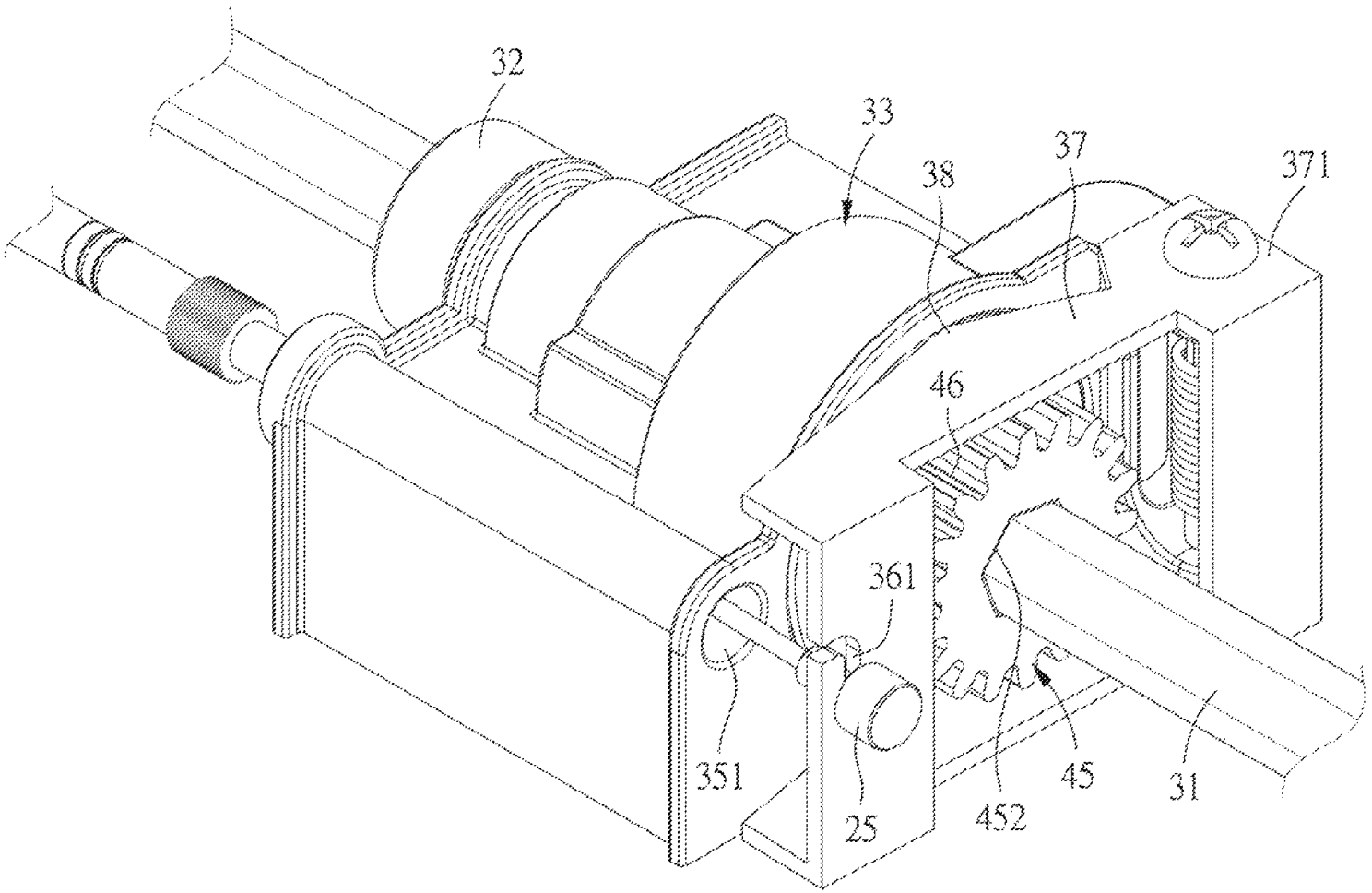
FIG. 5 is an assembly view of the clutch unit in accordance with the preferred embodiment of the present invention.
Figure 7:
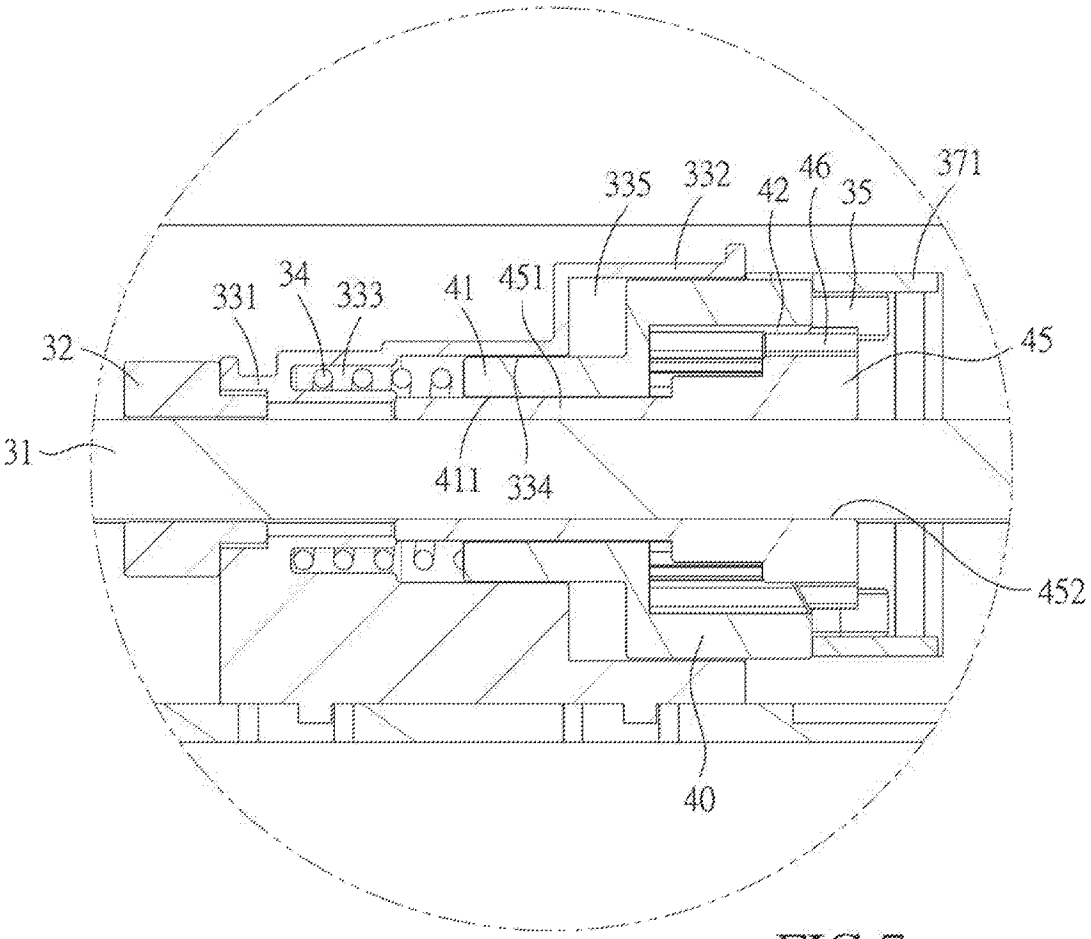
FIG. 7 is a cross sectional view of a part of the clutch unit in accordance with the present invention.

Referring then to FIGS. 4, 5 and 7, the fixing member 32 is sleeved onto the guide rod 31, and the base 33 is a hollow structure for insertion of the guide rod 31. As shown in FIGS. 1 and 2, the base 33 has a bottom fixed to the bottom of the U-shaped cross section of the fixing members 27. The base 33 has a first end 331 inserted on the guide rod 31 and connected to the fixing member 32. An inner annular groove 333 is formed at the first end 331 for receiving an elastic member 34. Beside the inner annular groove 333 is a non-circular engaging hole 334. A second end 332 of the base 33 has an outer diameter larger than an outer diameter of the first end 331. In the second end 332 is formed a connecting hole 335 which communicates with and has an inner diameter larger than an inner diameter of the engaging hole 334. The second end 332 of the base 33 is provided at one side thereof with a pivot end 35 in the form of two ears for pivotal connection of the drive member 36, and at another opposite side of the second end 332 is formed a passage 351 which extends along an axial direction of the base 33 and provided for insertion of the cable 25.

The drive member 36 is a hollow frame which is provided with an S-shaped retaining slot 361 which is formed at a terminal edge of the drive member 36, so that the cable 25 extends out of the passage 351 and is retained in the retaining slot 361, namely, the cable 25 is fixed to the drive member 36. The drive member 36 includes two horizontal lateral edges 37, each of the horizontal lateral edges 37 includes a pivotal end 371, and the pivotal ends 371 are clamped against the pivot end 35 to establish pivotal connection with the pivot end 35. A triangle-shaped press portion 38 is formed adjacent to a center of each of the horizontal lateral edges 37, and can be moved by the cable 25.

The movable wheel 40 includes an engaging end 41 which is engaged in the engaging hole 334 and provided with an axial hole 411. Another end of the movable wheel 40 is in diameter sized to axially movably fit in the connecting hole 335, so that the engaging end 41 is movable in the axial direction of the engaging hole 334 to press against the elastic member 34. An annular inner toothed portion 42 is formed on an inner surface of the another end of the movable wheel 40. The rotary wheel 45 includes a shaft portion 451 at one end thereof, and an outer toothed portion 46 at another end thereof The rotary wheel 45 is further axially formed with a positioning hole 452 which is non-circular in cross section. The shaft portion 451 is inserted in the axial hole 411 of the engaging end 41. Therefore, the guide rod 31 is inserted through the fixing member 32, the first end 331 of the base 33, the elastic member 34, the engaging hole 334, the positioning hole 452 of the rotary wheel 45, and the drive member 36, and then coupled to the connecting assemblies 15, as shown in FIG. 1. The connecting assemblies 15 provide a driving connection between the guide rod 31 and the pneumatic assemblies 12. After the movable wheel 40 is mounted on the base 33, the drive member 36 is pivoted to the base 33, and then pulling the cable 25 can make the press portion 38 of the drive member 36 push against or move away from the movable wheel 40.

Figure 6:
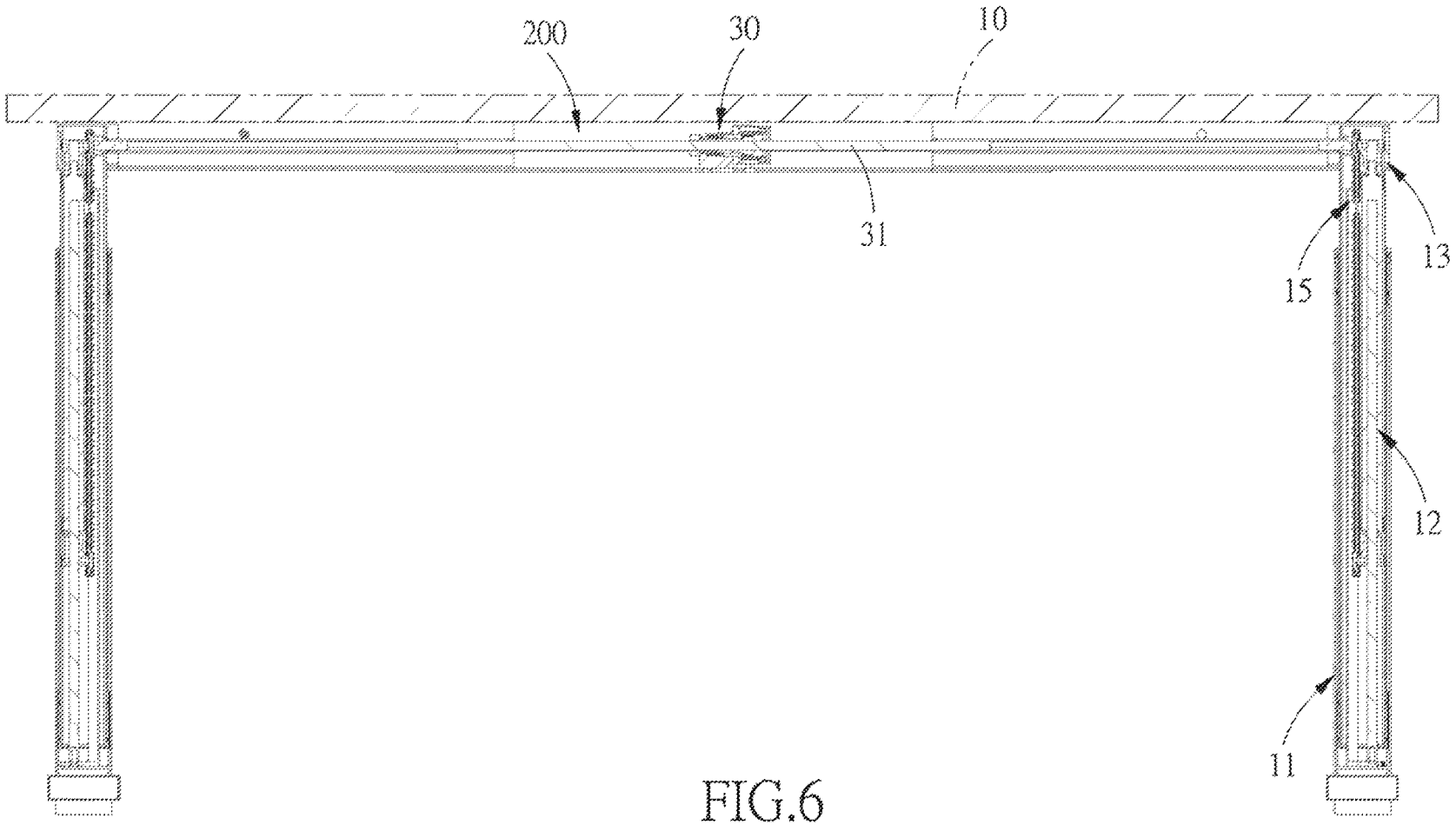
FIG. 6 is a front plan view of the lifting device for lifting a table in accordance with the preferred embodiment of the present invention.

Referring then to FIGS. 3 and 6, the synchronization mechanism 200 is disposed between the two fixing members 27, and has two ends connected to the two connecting assemblies 15. The cable 25 extends from one of the fixing members 27 and along the guide rod 31, and then is inserted through the passage 351 of the base 33 and finally retained in the retaining slot 361 of the drive member 36. As shown in FIGS. 1, 3 and 5, before height adjustment, the cable 25 is not pulled, the elastic member 34 is relieved, the movable wheel 40 is exposed out of the connecting hole 335 of the base 33, and the inner annular toothed portion 42 of the movable wheel 40 is engaged with the outer annular toothed portion 46 of the rotary wheel 45.

To adjust the height of the tabletop 10, as shown in FIGS. 9-12, a user can pull the cable 25 by gripping the gripping portion 22. The cable 25 moves within the casing 23 to pull the drive member 36, so that the drive member 36 pivots about the pivot end 35 toward the movable wheel 40 until the press portion 38 presses against the movable wheel 40, and the movable wheel 40 is moved along the axial direction of the base 33 to compress the elastic member 34. As a result, the inner annular toothed portion 42 of the movable wheel 40 is disengaged from the outer annular toothed portion 46 of the rotary wheel 45. At this moment, the pneumatic assemblies 12 can be actuated to make the connecting assemblies 15 rotate the guide rod 31 and the rotary wheel 45, and as a result, the inner rods 13 at both sides of the tabletop 10 are caused to move up with respect to the legs 11 in a synchronous manner due to the synchronization mechanism 200.

When the tabletop is adjusted to a desired height, the user can let go of the control handle 21 to release the cable 25, the drive member 36 is consequently released from the movable wheel 40, then the elastic member 34 pushes the movable wheel 40 back into the engagement position again where the inner annular toothed portion 42 of the movable wheel 40 is engaged with the outer annular toothed portion 46 of the rotary wheel 45 to stop the guide rod 31 from rotation. Therefore, the height of the tabletop 10 is fixed, and the synchronization mechanism ensures that the tabletop 10 is maintained in the horizontal position without tilting.

While we have shown and described various embodiments in accordance with the present invention, it is clear to those skilled in the art that further embodiments may be made without departing from the scope of the present invention.

What is claimed is:

1. A lifting device for lifting a table comprising two legs at two ends of a bottom of a tabletop, each of the legs including a pneumatic assembly and an inner rod, the pneumatic assemblies being disposed in the legs, and the inner rods being inserted in the legs and connected to the pneumatic assemblies, so that the pneumatic assemblies drive the inner rods to move up and down; the lifting device being characterized in that:

a synchronization mechanism is disposed between the two legs, and has two ends connected to the inner rods by two connecting assemblies, so that the inner rods are driven by the synchronization mechanism to lift or lower the tabletop in a synchronous manner, the synchronization mechanism includes: a cable control unit and a clutch unit controlled by the cable control unit, the cable control unit includes a control handle and a cable which is disposed at the bottom of the tabletop;

the clutch unit includes: a guide rod, and a base, a movable wheel, a rotary wheel which are inserted on the guide rod, and a drive member pivoted to the base, the guide rod has a non-circular cross section and is horizontally arranged with two ends connected to the two connecting assemblies, so that the guide rod is drivingly connected to the pneumatic assemblies of the legs, the base is fixed to the bottom of the tabletop and has a first end and a second end, an elastic member and an engaging hole are provided at the first end, a connecting hole which communicates with and has an inner diameter larger than an inner diameter of the engaging hole is formed in the second end, the second end is provided with a pivot end;

the drive member is a hollow frame with one end for fixing one end of the cable, and includes a pivotal end which is pivoted to the pivot end, and further includes a press portion;

the movable wheel includes an engaging end which is engaged in the engaging hole and provided with an axial hole, the movable wheel is movable in an axial direction of the engaging hole to press against the elastic member, an annular inner toothed portion is formed at another end of the movable wheel, the press portion is able to push against the movable wheel;

the rotary wheel includes a shaft portion at one end thereof, and an outer toothed portion at another end thereof, the rotary wheel is sleeved onto and rotates along with the guide rod, the shaft portion is inserted in the axial hole of the engaging end, the inner annular toothed portion of the movable wheel is able to engage with or disengage from the outer annular toothed portion of the rotary wheel, pulling the cable with the cable control unit can make the press portion of the drive member push the movable wheel to move, making the inner annular toothed portion of the movable wheel disengage from the outer annular toothed portion of the rotary wheel, the guide rod is able to make the two pneumatic assemblies lift or lower the tabletop in a synchronous manner.

2. The lifting device as claimed in claim 1, wherein the cable control unit includes a control handle, one end of the control handle is a gripping portion which is inserted in one end of a casing and provided with a retaining block to retain one end of the cable which extends out of another end of the casing.

3. The lifting device as claimed in claim 1, wherein two fixing members which are U-shaped in cross section are disposed at the two ends of the bottom of the tabletop in such a manner that each of the fixing members has two free ends fixed to the bottom of the tabletop and connected to the top of a corresponding one of the inner rods, and the base has a bottom fixed to a bottom of the U-shaped cross section of the fixing members.

4. The lifting device as claimed in claim 1, wherein the fixing member is sleeved onto the guide rod, and the base has a first end connected to the fixing member.

5. The lifting device as claimed in claim 1, wherein an inner annular groove is formed at the first end for receiving an elastic member, a non-circular engaging hole is formed beside the inner annular groove, and the movable wheel has an engaging end engaged in the engaging hole.

6. The lifting device as claimed in claim 1, wherein a passage is formed at the second end of the base for insertion of the cable.

7. The lifting device as claimed in claim 1, wherein the drive member is provided with an S-shaped retaining slot for retaining the cable.

8. The lifting device as claimed in claim 1, wherein the drive member includes two horizontal lateral edges, each of the horizontal lateral edges includes a pivotal end, and the pivotal ends are clamped against the pivot end to establish pivotal connection with the pivot end, and a triangle-shaped press portion is formed adjacent to a center of each of the horizontal lateral edges to push against the movable wheel.

9. The lifting device as claimed in claim 1, wherein the guide rod is inserted in the positioning hole of the rotary wheel, and the positioning hole is non-circular in cross section.

10. The lifting device as claimed in claim 1, wherein the guide rod includes an inserting section and two movable sections which are movably inserted at two ends of the inserting section.

* * * * *